US005926949A

United States Patent [19]

Moe et al.

[11] Patent Number: 5,926,949

[45] Date of Patent: Jul. 27, 1999

[54] METHOD OF MAKING COAXIAL CABLE

[75] Inventors: Alan N. Moe, Hickory; Mark A. Garner, Newton, both of N.C.

[73] Assignee: CommScope, Inc. of North Carolina, Hickory, N.C.

[21] Appl. No.: 08/865,407

[22] Filed: May 29, 1997

Related U.S. Application Data

[60] Provisional application No. 60/018,861, May 30, 1996, and provisional application No. 60/018,777, May 31, 1996.

[51] Int. Cl.[6] ..... H01B 13/20

[52] U.S. Cl. ..... 29/828; 156/54; 156/55; 174/88 R

[58] Field of Search ..... 29/825, 828, 869, 29/871; 156/54, 55; 174/88 R

[56] References Cited

U.S. PATENT DOCUMENTS

| | | | |
|---|---|---|---|
| 2,754,350 | 7/1956 | Hurd . | |
| 3,230,299 | 1/1966 | Radziejowski . | |
| 3,340,353 | 9/1967 | Mildner . | |
| 3,433,687 | 3/1969 | Price . | |
| 3,594,491 | 7/1971 | Zeidlhack . | |
| 3,643,007 | 2/1972 | Roberts et al. . | |
| 3,688,016 | 8/1972 | Spade . | |
| 4,008,367 | 2/1977 | Sünderhauf . | |
| 4,059,724 | 11/1977 | Ide . | |
| 4,083,484 | 4/1978 | Polizzano et al. | 29/828 X |
| 4,104,481 | 8/1978 | Wilkenloh et al. . | |
| 4,327,248 | 4/1982 | Campbell . | |
| 4,376,920 | 3/1983 | Smith . | |
| 4,407,065 | 10/1983 | Gray | 29/828 |
| 4,416,061 | 11/1983 | Aanerud et al. | 29/828 |
| 4,472,595 | 9/1984 | Fox et al. . | |
| 4,484,023 | 11/1984 | Gindrup . | |
| 5,194,838 | 3/1993 | Cobo . | |
| 5,254,188 | 10/1993 | Blew . | |
| 5,519,172 | 5/1996 | Spencer et al. . | |

FOREIGN PATENT DOCUMENTS

| | | | |
|---|---|---|---|
| 0 099 722 | 2/1984 | European Pat. Off. . | |
| 0 099 723 | 2/1989 | European Pat. Off. . | |
| 0 625 784 A2 | 11/1994 | European Pat. Off. . | |
| 1 346 466 | 2/1974 | United Kingdom . | |
| 2063583 | 6/1981 | United Kingdom | 29/828 |

*Primary Examiner*—Carl J. Arbes
*Attorney, Agent, or Firm*—Alston & Bird LLP

[57] ABSTRACT

A method of making a flexible coaxial cable is provided. The method comprises advancing a cable core comprising a conductor and an expanded foam dielectric surrounding the conductor along a predetermined path of travel, directing an elongate strip of copper onto the advancing cable core and bending the copper strip into a generally cylindrical form so as to loosely encircle the core. Opposing longitudinal edges of the thus formed copper strip are then moved into abutting relation and a longitudinal weld is formed joining the abutting edges to thereby form an electrically and mechanically continuous tubular copper sheath loosely surrounding the cable core. The cable core and the surrounding sheath are simultaneously advanced while the tubular sheath is deformed into an oval configuration loosely surrounding the core. The longitudinal weld of the advancing sheath is then directed against a scarfing blade and weld flash from the sheath is scarfed from the sheath. The advancing copper sheath is sunk onto the advancing cable core to form the coaxial cable. A polymer composition may be extruded around the copper sheath to form a protective jacket surrounding the coaxial cable and may be bonded thereto. The present invention also includes a flexible coaxial cable having excellent electrical and bending properties.

14 Claims, 5 Drawing Sheets

METHOD OF MAKING COAXIAL CABLE

CROSS-REFERENCE TO RELATED APPLICATIONS

This application is related to commonly owned provisional applications Ser. No. 60/018,861 filed May 30, 1996 and Ser. No. 60/018,777 filed May 31, 1996, now abandoned and claims the benefit of the earlier filing dates of these applications under 35 U.S.C. § 119(e)

FIELD OF THE INVENTION

The present invention relates to a coaxial cable, and more particularly to an improved low-loss coaxial cable having enhanced bending and handling characteristics and improved attenuation properties for a given nominal size.

BACKGROUND OF THE INVENTION

The coaxial cables commonly used today for transmission of RF signals, such as cable television signals and cellular telephone broadcast signals, for example, include a core containing an inner conductor, a metallic sheath surrounding the core and serving as an outer conductor, and in some instances a protective jacket which surrounds the metallic sheath. A dielectric surrounds the inner conductor and electrically insulates it from the surrounding metallic sheath. In many known coaxial cable constructions, an expanded foam dielectric surrounds the inner conductor and fills the space between the inner conductor and the surrounding metallic sheath.

One of the design criteria which must be considered in producing any coaxial cable is that the cable must have sufficient compressive strength to permit bending and to withstand the general abuse encountered during normal handling and installation. For example, installation of the coaxial cable may require passing the cable around one or more rollers as the cable is strung on utility poles. Any buckling, flattening or collapsing of the tubular metallic sheath which might occur during such installation has serious adverse consequences on the electrical characteristics of the cable, and may even render the cable unusable. Such buckling, flattening or collapsing also destroys the mechanical integrity of the cable and introduces the possibility of leakage or contamination.

Traditionally, the preferred material for the metallic sheaths used in coaxial cables has been aluminum. Aluminum has been selected because of its low cost and good mechanical and electrical properties. Nevertheless, despite its benefits, aluminum does have some disadvantages. In particular, aluminum is susceptible to corrosion at the connector interface which can cause intermodulation distortion of the RF signals. Furthermore, although highly conductive, other metals exhibit greater conductivity than aluminum.

One alternative to aluminum as the outer conductor or sheath is copper. Copper possesses better electrical properties than aluminum. However, copper is more expensive and has a higher compressive yield strength than aluminum, which contributes to poor bending properties. For these reasons, copper has not been used traditionally as the sheath material for coaxial cables. The use of a thinner copper layer can reduce the cost, but thin copper sheaths are even more susceptible to buckling and are very difficult to process.

SUMMARY OF THE INVENTION

In view of the foregoing, it is an object of the present invention to provide a method of forming a coaxial cable having excellent electrical properties.

It is a further object of the present invention to provide a method of forming a coaxial cable having a copper outer conductor which is mechanically and electrically continuous.

It is a still further object of the present invention to provide a method of forming a coaxial cable which possesses excellent bending properties and is not subject to buckling.

These and other objects are achieved in accordance with the present invention by a method wherein a cable core comprising a conductor and an expanded foam dielectric surrounding the conductor is advanced along a predetermined path of travel and an elongate strip of copper is directed onto the advancing cable core and bent into a generally cylindrical form so as to loosely encircle the core. Opposing longitudinal edges of the thus formed copper strip are then moved into abutting relation and a longitudinal weld is formed joining the abutting edges to thereby form an electrically and mechanically continuous tubular copper sheath loosely surrounding the cable core. The cable core and the surrounding sheath are simultaneously advanced while the tubular sheath is deformed into an oval configuration loosely surrounding the core, the oval configuration having a major axis generally aligned with the longitudinal weld of said sheath. The longitudinal weld of the advancing sheath is then directed against a scarfing blade and weld flash from the sheath is scarfed from the sheath. The advancing copper sheath is sunk onto the advancing cable core to form the coaxial cable. A polymer composition may be extruded around the copper sheath to form a protective jacket surrounding the coaxial cable and may be bonded thereto.

The present invention also provides a coaxial cable comprising a core including at least one inner conductor and a foam polymer dielectric surrounding the inner conductor, an electrically and mechanically continuous smooth-walled longitudinally welded tubular copper sheath closely surrounding said core and adhesively bonded thereto, and a protective outer jacket surrounding said sheath, wherein the ratio of the thickness of said tubular copper sheath to the diameter of said tubular copper sheath is less than about 1.6 percent. The coaxial cable may further include a layer of adhesive between the sheath and the protective outer jacket serving to bond the protective outer layer to the sheath. The tubular copper sheath is thin, preferably, having a thickness of less than 0.013 inch.

These and other features of the present invention will become more readily apparent to those skilled in the art upon consideration of the following detailed description which describes both the preferred and alternative embodiments of the invention.

DETAILED DESCRIPTION OF THE INVENTION

Figure 1:
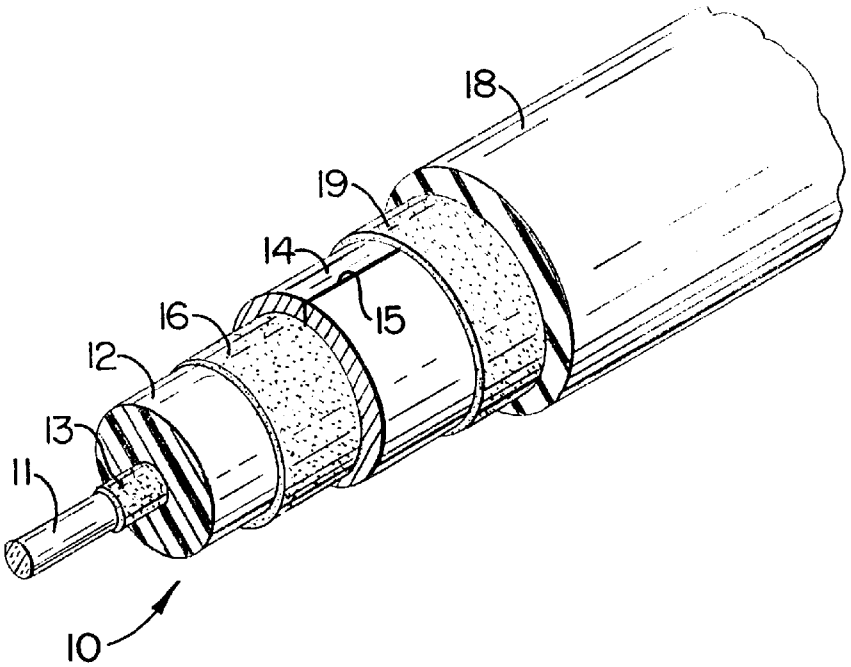
FIG. 1 is a perspective view showing a coaxial cable in accordance with the present invention in cross-section and with portions of the cable broken away for purposes of clarity of illustration.

FIG. 1 illustrates a coaxial cable produced in accordance with the present invention. The coaxial cable comprises a core 10 which includes an inner conductor 11 of a suitable electrically conductive material, and a surrounding continuous cylindrical wall of expanded foam plastic dielectric material 12. Preferably, the foam dielectric 12 is adhesively bonded to the inner conductor 11 by a thin layer of adhesive 13 such that the bond between the inner conductor 11 and dielectric 12 is stronger than the dielectric material. The inner conductor 11 is preferably solid copper, copper tubing or a copper-clad aluminum. The inner conductor 11 preferably has a smooth surface and is not corrugated. In the embodiment illustrated, only a single inner conductor 11 is shown, as this is the most common arrangement for coaxial cables of the type used for transmitting RF signals such as cable television signals, or radio signals such as cellular telephone broadcast signals. However, it would be understood that the present invention is applicable also to coaxial cables having more than one inner conductor insulated from one another and forming a part of the core 10.

The dielectric 12 is a low loss dielectric formed of a suitable plastic such as polyethylene, polypropylene, and polystyrene. Preferably, in order to reduce the mass of the dielectric per unit length and hence reduce the dielectric constant, the dielectric material should be of an expanded cellular foam composition, and in particular, a closed cell foam composition is preferred because of its resistance to moisture transmission. Preferably, the cells of the dielectric 12 are uniform in size and less than 200 microns in diameter. One suitable foam dielectric is an expanded high density polyethylene polymer such as described in commonly owned U.S. Pat. No. 4,104,481, issued Aug. 1, 1978. Additionally, expanded blends of high and low density polyethylene are preferred for use as the foam dielectric. The foam dielectric has a density of less than about 0.28 g/cc, preferably, less than about 0.22 g/cc.

Although the dielectric 12 of the invention generally consists of a uniform layer of foam material, the dielectric 12 may have a gradient or graduated density such that the density of the dielectric increases radially from the inner conductor 11 to the outside surface of the dielectric, either in a continuous or a step-wise fashion. For example, a foam-solid laminate dielectric can be used wherein the dielectric 12 comprises a low density foam dielectric layer surrounded by a solid dielectric layer. These constructions can be used to enhance the compressive strength and bending properties of the cable and permit reduced densities as low as 0.10 g/cc along the inner conductor 11. The lower density of the foam dielectric 12 along the inner conductor 11 enhances the velocity of RF signal propagation and reduces signal attenuation.

Closely surrounding the core is a continuous tubular smooth-walled copper sheath 14. The sheath 14 is characterized by being both mechanically and electrically continuous. This allows the sheath 14 to effectively serve to mechanically and electrically seal the cable against outside influences as well as to seal the cable against leakage of RF radiation. Alternatively, the sheath can be perforated to allow controlled leakage of RF energy for certain specialized radiating cable applications. The tubular copper sheath 14 of the invention preferably employs a thin walled copper sheath as the outer conductor. The tubular copper sheath 14 has a wall thickness selected so as to maintain a T/D ratio (ratio of wall thickness to outer diameter) of less than 2.5 percent and preferably less than 1.6 percent or even 1.0 percent or lower. Preferably, the thickness of the copper sheath 14 is less than 0.013 inch to provide the desired bending and electrical properties of the invention. In addition, the tubular copper sheath 14 is smooth-walled and not corrugated. The smooth-walled construction optimizes the geometry of the cable to reduce contact resistance and variability of the cable when connectorized and to eliminate signal leakage at the connector.

In the preferred embodiment illustrated, the tubular copper sheath 14 is made from a copper strip S formed into a tubular configuration with the opposing side edges of the copper strip butted together, and with the butted edges continuously joined by a continuous longitudinal weld, indicated at 15. While production of the sheath 14 by longitudinal welding has been illustrated as preferred, persons skilled in the art will recognize that other methods for producing a mechanically and electrically continuous thin walled tubular copper sheath could also be employed.

The inner surface of the tubular sheath 14 is continuously bonded throughout its length and throughout its circumferential extent to the outer surface of the foam dielectric 12 by a thin layer of adhesive 16. A preferred class of adhesive for this purpose is a random copolymer of ethylene and acrylic acid (EAA). The adhesive layer 16 should be made as thin as possible so as to avoid adversely affecting the electrical characteristics of the cable. Desirably, the adhesive layer 16 should have a thickness of about 1 mil or less.

The outer surface of the sheath 14 is surrounded by a protective jacket 18. Suitable compositions for the outer protective jacket 18 include thermoplastic coating materials such as polyethylene, polyvinyl chloride, polyurethane and rubbers. Although the jacket 18 illustrated in FIG. 1 consists of only one layer of material, laminated multiple jacket layers may also be employed to improve toughness, strippability, burn resistance, the reduction of smoke generation, ultraviolet and weatherability resistance, protection against rodent gnaw through, strength resistance, chemical resistance and/or cut-through resistance. In the embodiment illustrated, the protective jacket 18 is bonded to the outer surface of the sheath 14 by an adhesive layer 19 to thereby increase the bending properties of the coaxial cable. Preferably, the adhesive layer 19 is a thin layer of adhesive, such as the EAA copolymer described above. Although an adhesive layer 19 is illustrated in FIG. 1, the protective jacket 18 can also be directly bonded to the outer surface of the sheath 14 to provide the bending properties of the invention.

Figure 2:
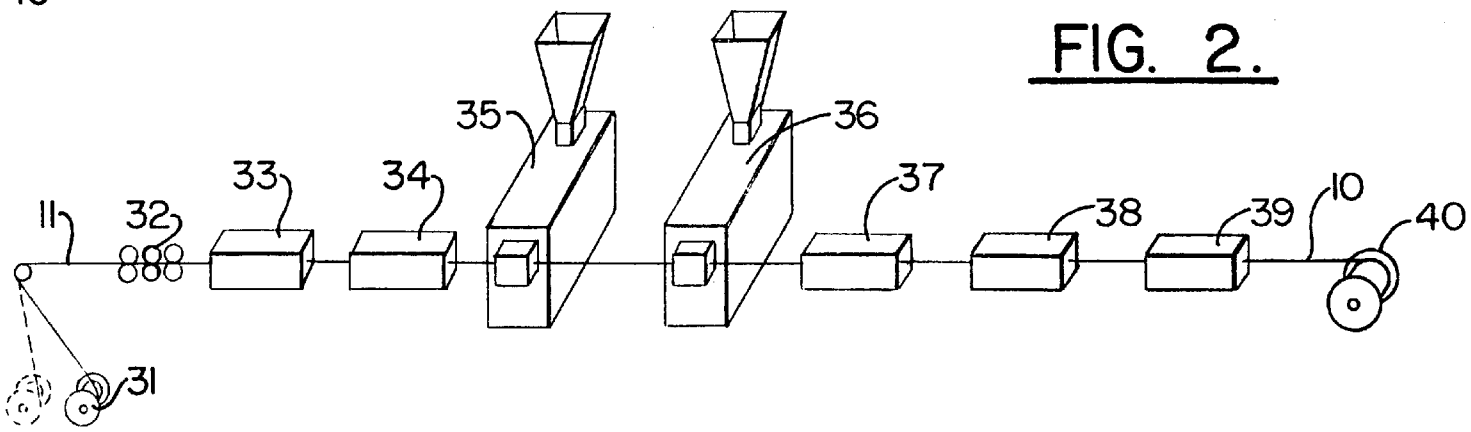
FIG. 2 is a schematic illustration of an apparatus for producing an adhesive coated core for use in the coaxial cable of the invention.

FIG. 2 illustrates a suitable arrangement of apparatus for producing the cable shown in FIG. 1. As illustrated, the inner conductor 11, typically a solid copper wire, a hollow copper tube or a copper-clad aluminum wire, is directed from a suitable supply source, such as a reel 31. In order to provide a coaxial cable having a continuous inner conductor 11, the terminal edge of the inner conductor from one reel is mated with the initial edge of the inner conductor from the subsequent reel and welded together. It is important in forming a continuous cable to weld the copper tubes or wires from different reels without adversely affecting the surface characteristics and therefore the electrical properties of the inner conductor 11, especially when using hollow copper tubes.

The inner conductor 11 is subsequently straightened to remove kinks. In the illustrated embodiments this is accomplished by advancing the conductor 11 through a series of straightening rolls 32 and through a drawing die 33. Once the inner conductor 11 has been straightened, a gas burner 34 is used to heat the surface of the inner conductor to remove excess water and organics from the surface of the inner conductor. If the inner conductor 11 and the foam dielectric 12 are to be adhesively bonded, heating the surface of the inner conductor 11 also serves to facilitate adhesion of the adhesive layer 13 on the surface of the inner conductor 11. Preferably, an adhesive layer 13 is applied to the inner conductor 11 which allows the foam dielectric 12 to adhere to the inner conductor but which still provides a strippable core 10. The adhesive layer 13 used to bond the inner conductor 11 to the foam dielectric 12 is typically extruded onto the surface of the inner conductor using an extruder 35 and crosshead die or similar device.

The coated inner conductor 11 is advanced through an extruder apparatus 36 which applies a foamable polymer composition used to form the foam dielectric 12. In the extruder apparatus 36 the components to be used for the foam dielectric 12 are combined to form a polymer melt. Preferably, high density polyethylene and low density polyethylene are combined with nucleating agents in an extruder apparatus to form the polymer melt. These compounds once melted together are subsequently injected with nitrogen gas or a similar blowing agent to form the foamable polymer composition. In addition to or in place of the blowing agent, decomposing or reactive chemical agents can be added to form the foamable polymer composition. The foamable polymer composition then passes through screens to remove impurities in the melt. In extruder apparatus 36, the polymer melt is continuously pressurized to prevent the formation of gas bubbles in the polymer melt. The extruder apparatus 36 continuously extrudes the polymer melt concentrically around the advancing inner conductor 11. Upon leaving the extruder 36, the reduction in pressure causes the foamable polymer composition to foam and expand to form a continuous cylindrical wall of the foam dielectric 12 surrounding the inner conductor 11.

In addition to the foamable polymer composition, an ethylene acrylic acid (EAA) adhesive composition is preferably coextruded with the foamable polymer composition to form adhesive layer 16. Extruder apparatus 36 continuously extrudes the adhesive composition concentrically around the polymer melt. Although coextrusion of the adhesive composition with the polymer melt is preferred, other suitable methods such as spraying, immersion, or extrusion in a separate apparatus may also be used to apply the adhesive composition to the core 10.

In order to produce low foam dielectric densities along the inner conductor 11 of the cable, the method described above can be altered to provide a gradient or graduated density dielectric. For example, for a multilayer dielectric having a low density inner foam layer and a high density foam or solid outer layer, the polymer compositions forming the layers of the dielectric can be coextruded together and can further be coextruded with the adhesive composition forming adhesive layer 16. Alternatively, the dielectric layers can be extruded separately using successive extruder apparatus. Other suitable methods can also be used. For example, the temperature of the inner conductor 11 may be elevated to increase the size and therefore reduce the density of the cells along the inner conductor to form a dielectric having a radially increasing density.

After leaving the extruder apparatus 36, the adhesive coated core 10 may be directed through an adhesive drying station 37 such as a heated tunnel or chamber. Upon leaving the drying station 37, the core is directed through a cooling station 38 such as a water trough. Water is then generally removed from the core 10 by an air wipe 39 or similar device. At this point, the adhesive coated core 10 may be collected on suitable containers, such as reels 40 prior to being further advanced through the remainder of the manufacturing process illustrated in FIG. 3. Alternatively, the adhesive coated core 10 can be continuously advanced through the remainder of the manufacturing process without being collected on reels 40.

Figure 3:
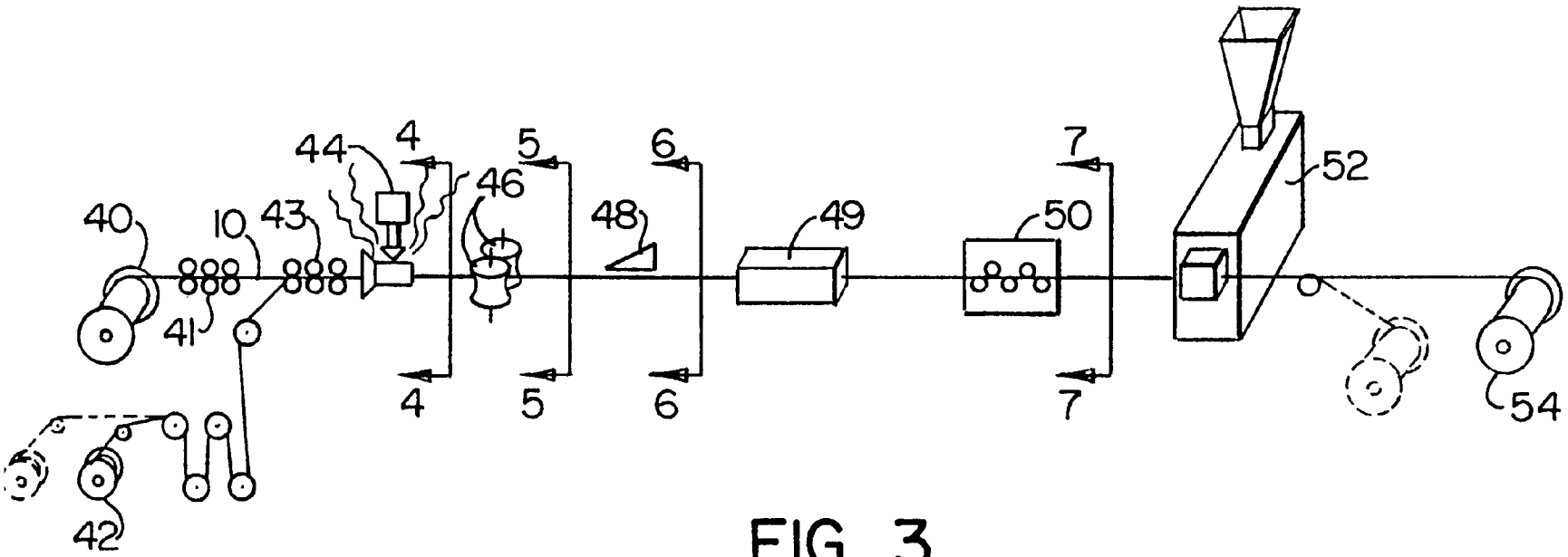
FIG. 3 is a schematic illustration of an apparatus for applying a sheath and jacket to an adhesive coated core to produce the coaxial cable of the invention.
Figure 4:
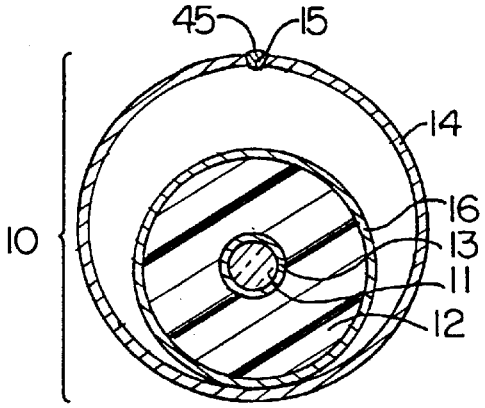
FIG. 4 is a cross-sectional view of FIG. 3 along lines 4—4 and illustrating the core and the sheath after longitudinal welding of the sheath.

As illustrated in FIG. 3, the adhesive coated core 10 can be drawn from reels 40 and further processed to form the coaxial cable. Typically, the adhesive coated core 10 is straightened by advancing the adhesive coated core through a series of straightening rolls 41. A narrow elongate strip S from a suitable supply source such as reel 42 is then directed around the advancing core and bent into a generally cylindrical form by guide rolls 43 so as to loosely encircle the core. Opposing longitudinal edges of the thus formed copper strip S are then moved into abutting relation and the strip is advanced through a welding apparatus 44 which forms a longitudinal weld 15 by joining the abutting edges of the copper strip S. As illustrated in FIG. 4, the longitudinally welded strip forms an electrically and mechanically continuous copper sheath 14 loosely surrounding the core 10. As a result of the longitudinal welding of the copper sheath 14, weld flash 45 is present adjacent the longitudinal weld 15.

Figure 5:
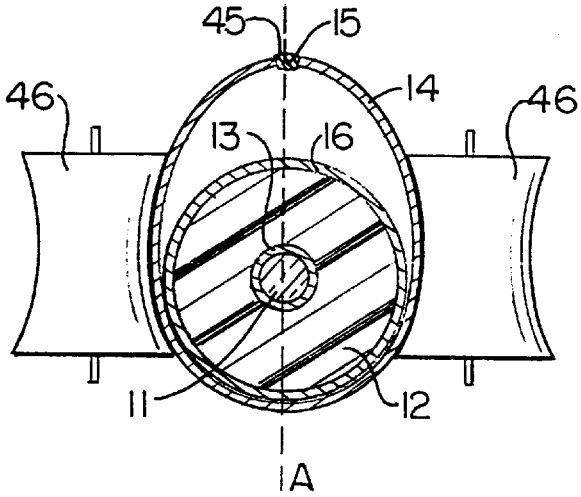
FIG. 5 is a cross-sectional view of FIG. 3 along lines 5—5 and illustrating the core and the sheath after the sheath is deformed into an oval configuration.
Figure 6:
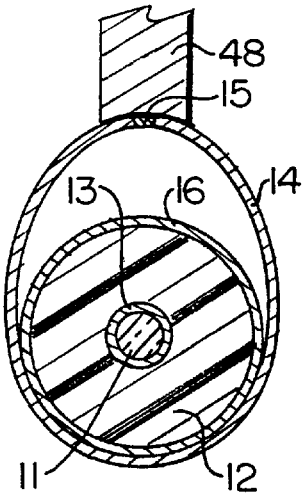
FIG. 6 is a cross-sectional view of FIG. 3 along lines 6—6 and illustrating the core and the sheath after the weld flash is scarfed from the sheath.
Figure 7:
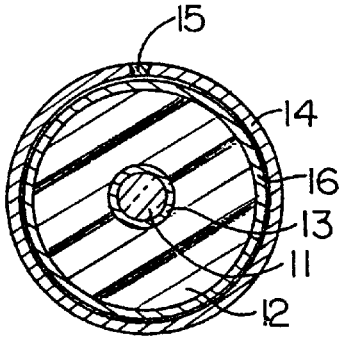
FIG. 7 is a cross-sectional view of FIG. 3 along lines 7—7 and illustrating the core and the sheath after sinking the sheath onto the core.

As the core 10 and surrounding sheath 14 simultaneously advance, the sheath 14 is formed by a pair of shaping rolls 46 into an oval configuration (FIG. 5) loosely surrounding the core and having a major axis A generally aligned with the longitudinal weld 15 of the sheath. As illustrated in FIG. 6, the longitudinal weld 15 of the advancing sheath 14 is then directed against a scarfing blade 48 which scarfs weld flash 45 from the sheath 14. The oval configuration of the thin sheath 14 increases the compressive strength of the thin copper sheath when directed against the scarfing blade 48 and prevents buckling, flattening or collapsing of the sheath. Once the weld flash 45 is scarfed from the sheath 14, the simultaneously advancing core 10 and surrounding sheath 14 are then advanced through a shaping die 49, which reforms the sheath 14 from an oval configuration into a generally circular configuration loosely surrounding the core. The simultaneously advancing core 10 and surrounding sheath 14 are then advanced through at least one sinking die 50 which sinks the copper sheath onto the cable core as shown in FIG. 7, and thereby causes compression of the foam dielectric 12. A lubricant is preferably applied to the surface of the sheath 14 as it advances through the sinking die 40.

Once the sheath 14 has been formed on the core 10, any lubricant on the outer surface of the sheath is removed to increase the ability of the sheath to bond to the protective jacket 18. An adhesive layer 19 and the polymeric jacket 18 are then formed onto the outer surface of the sheath 14. In the present invention, the outer protective jacket 18 is provided by advancing the core 10 and surrounding sheath 14 through an extruder apparatus 52 where a polymer composition is extruded concentrically in surrounding relation to the adhesive layer 19 to form the protective jacket 18. Preferably, a molten adhesive composition such as an EAA copolymer is coextruded concentrically in surrounding relation to the sheath 14 with the polymer composition which is in concentrically surrounding relation to the molten adhesive composition to form the adhesive layer 19 and protective jacket 18. Where multiple polymer layers are used to form the jacket 18, the polymer compositions forming the multiple layers may be coextruded together in surrounding relation and with the adhesive composition forming adhesive layer 19 to form the protective jacket. Additionally, a longitudinal tracer stripe of a polymer composition contrasting in color to the protective jacket 18 may be coextruded with the polymer composition forming the jacket for labeling purposes.

The heat of the polymer composition forming the protective jacket 18 serves to activate the adhesive layer 16 to form an adhesive bond between the inner surface of sheath 14 and the outer surface of the dielectric 12. Once the protective jacket 18 has been applied, the coaxial cable is subsequently quenched to cool and harden the materials in the coaxial cable. The use of adhesive layers between the inner conductor 11, dielectric 12, sheath 14, and protective jacket 18 also provide the added benefit of preventing the migration of water through the cable and generally provide the cable with increased bending properties. Once the coaxial cable has been quenched and dried, the thus produced cable may then be collected on suitable containers, such as reels 54, suitable for storage and shipment.

The coaxial cables of the present invention are beneficially designed to limit buckling of the copper sheath during bending of the cable. During bending of the cable, one side of the cable is stretched and subject to tensile stress and the opposite side of the cable is compressed and subject to compressive stress. If the core is sufficiently stiff in radial compression and the local compressive yield load of the sheath is sufficiently low, the tensioned side of the sheath will elongate by yielding in the longitudinal direction to accommodate the bending of the cable. Accordingly, the compression side of the sheath preferably shortens to allow bending of the cable. If the compression side of the sheath does not shorten, the compressive stress caused by bending the cable can result in buckling of the sheath.

The ability of the sheath to bend without buckling depends on the ability of the sheath to elongate or shorten by plastic material flow. Typically, this is not a problem on the tensioned side of the cable. On the compression side of the tube, however, the sheath will compress only if the local compressive yield load of the sheath is less than the local critical buckling load. Otherwise, the cable will be more likely to buckle thereby negatively effecting the mechanical and electrical properties of the cable. For annealed aluminum sheath materials, the local compressive yield load is sufficiently low in cable designs to avoid buckling failures on the compression side of the cable. However, for materials having significantly higher compressive yield strengths, such as copper, the possibility of buckling increases significantly because the higher compressive yield loads can exceed the critical buckling loads of the sheath. This is particularly true as the thickness of the outer conductor decreases because the corresponding critical buckling load tends to decrease at a faster rate than the compressive yield load. Therefore, there is a greater tendency for thin copper sheaths to buckle than thicker aluminum sheaths.

For the cables of the present invention, it has been discovered that the critical buckling load can be significantly increased by adhesively bonding the sheath to the core and to the protective jacket. In particular, adhesive bonds between the sheath and the jacket having the bond peel strengths discussed herein, provide high critical buckling loads and thus reduced buckling. This allows thin copper sheaths to be used in the present invention therefore increasing the flexibility of the cable. Furthermore, the critical buckling load can be significantly increased by increasing the stiffness of the core. Although the stiffness can be increased by increasing the density of the dielectric, higher densities result in increased attenuation along the inner conductor. An alternative method, as described herein, is providing a low density foam dielectric along the inner conductor for low attenuation and a high density foam or solid dielectric along the copper sheath to increase the stiffness of the core along the sheath thereby supporting the sheath in bending.

The coaxial cables of the present invention have enhanced bending characteristics over conventional coaxial cables. As described above, one feature which enhances the bending characteristics of the cable is the use of a very thin copper sheath 14. Another feature which enhances the bending characteristics of the coaxial cable of the invention is that the sheath 14 is adhesively bonded to the foam dielectric 12 and the protective jacket 18. In this relationship, the foam dielectric 12 and the jacket 18 support the sheath 14 in bending to prevent damage to the coaxial cable. Furthermore, increased core stiffness in relation to sheath stiffness is beneficial to the bending characteristics of the coaxial cable. Specifically, the coaxial cables of the invention have a core to sheath stiffness ratio of at least 5, and preferably of at least 10. In addition, the minimum bend radius in the coaxial cables of the invention is significantly less than 10 cable diameters, more on the order of about 7 cable diameters or lower. The reduction of the tubular sheath wall thickness is such that the ratio of the wall thickness to its outer diameter (T/D ratio) is no greater than about 2.5 percent and preferably no greater than about 1.6 percent. The reduced wall thickness of the sheath contributes to the bending properties of the coaxial cable and advantageously reduces the attenuation of RF signals in the coaxial cable. The combination of these features and the properties of the sheath 14 described above results in a tubular copper sheath with significant bending characteristics.

Figure 8:
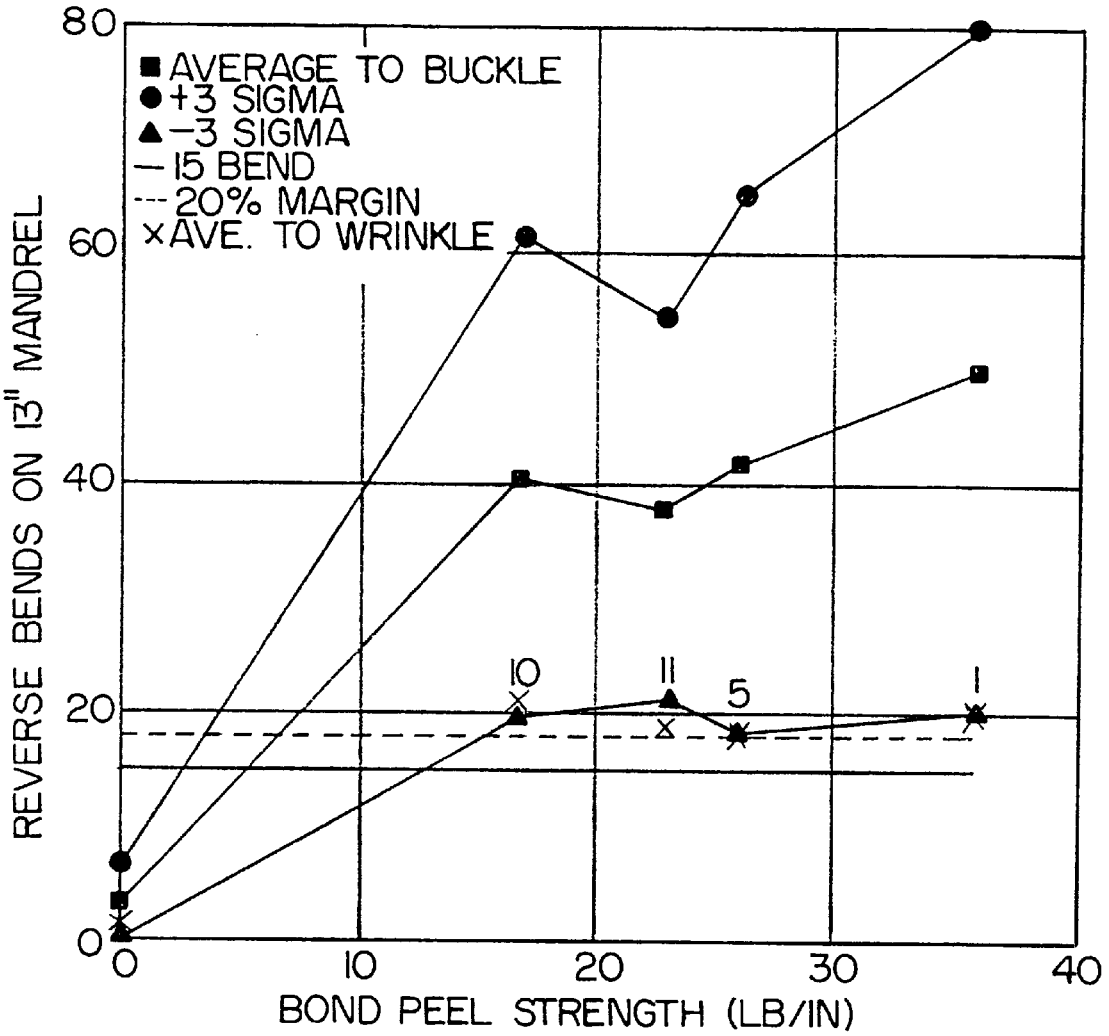
FIG. 8 is a graph demonstrating the relationship between the bond peel strength of the adhesive layer between the sheath and the jacket and the bending properties of a coaxial cable formed according to the invention with each point representing the average of 20 tests.
Figure 9:
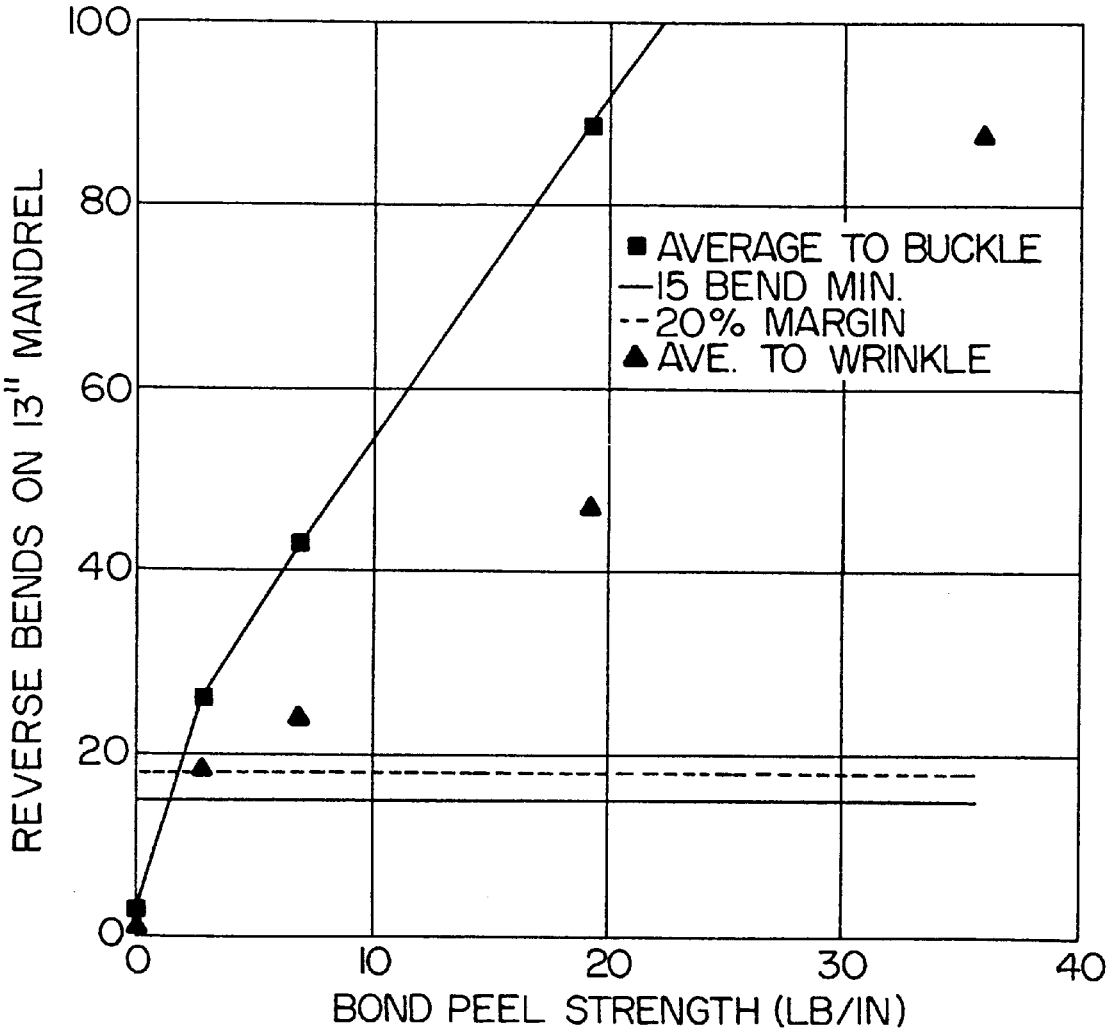
FIG. 9 is a graph demonstrating the relationship between the bond peel strength of the adhesive layer between the sheath and the jacket and the bending properties of a coaxial cable formed according to the invention with each point representing the average of 20 tests and the sheath having a smoother outer surface than in the coaxial cable tested in FIG. 8.

As stated briefly above, the bending characteristics of the coaxial cable are further improved by providing an adhesive layer 19 between the tubular copper sheath 14 and the outer protective jacket 18. The bending properties of the coaxial cable (as measured by the number of reverse bends the cable can sustain on a thirteen inch diameter mandrel without buckling) increase generally as the bond peel strength of the adhesive layer increases. Nevertheless, as illustrated in FIG. 8, it has been discovered that when the strength of the bond reaches a certain level, e.g. 36 lb/in, the protective jacket becomes too difficult to remove to provide electrical connections between the coaxial cable and other conductive elements. Furthermore, the increased use of adhesive results in an increase in the cost of manufacturing the cable and a decrease in electrical properties. On the other hand, when the strength of the adhesive bond is below a certain level, the adhesive bond is not sufficient to provide the desired bending characteristics of the coaxial cable. Although the lower level for the bond peel strength of the adhesive bond illustrated in FIG. 8 is 10 lb/in, it has been discovered (as demonstrated in FIG. 9) that by controlling the smoothness of the sheath, e.g., by controlling the lubrication of the sheath in the sinking die, that the lower level can be as low as 5 lb/in.

The bond peel strength described herein is determined using an 180° jacket peel back test. For the 180° jacket peel back test, an eighteen inch sample is cut from each reel of cable to be tested. A twelve inch piece of the sample is placed in a jacket slicing device and the slitter blade in the slicing device is set to cut through the jacket. The cable is pulled through the slicing device until a twelve inch slit is cut in the sample or until the end of the sample is reached. For smaller cables, four slits equally spaced apart are cut into the cable. For larger cables, six slits equally spaced apart are cut into the cable. A knife is used to loosen the jacket from the cable at the slit end. The jacket is then pulled back about four inches from the end of the cable. A loop is formed from the peeled back jacket and stapled. A MG100L force gauge is turned on and set to a Peak T setting. The force gauge is hooked onto the loop and slowly pulls on the loop until the force stops changing. The force on the gauge is recorded and the procedure repeated for each section of the cable (quadrant for smaller cables). The minimum and maximum width for each section is also measured using calipers and recorded to determine the average width. The force/unit width (e.g., lb/in) is determined by the equation:

$$\text{force/unit width} = \text{force/average width}$$

which is measured for each quadrant and recorded. The bond peel strength is the average of the four (six) measurements.

The present invention provides a coaxial cable with excellent bending properties and having an outer protective jacket which can be easily removed from the cable to provide an electrical connection between the coaxial cable and other conductive elements. In order to provide a cable which possesses both of these properties, it has been determined that the bond peel strength of the adhesive layer between the tubular copper sheath and the outer protective layer as measured by a 180° jacket peel back test should be no more than about 36 lb/in. Preferably, the bond peel strength should be between about 5 and 36 lb/in. In one embodiment of the invention, the bond peel strength is between about 10 and 36 lb/in. This range of bond peel strengths has been discovered to be an especially important range for copper sheaths. Because copper has a higher compressive yield strength and modulus than aluminum, the bond strength of the adhesive layer 19 generally must be stronger for a copper sheath than for an aluminum sheath. Therefore, defining a range of suitable bond strengths for copper sheaths is important in the manufacture of the coaxial cables of the invention.

The coaxial cables of the invention have found particular utility in 50 ohm applications. As is known to those skilled in the art, 50 ohm applications are the standard for the precision signal industry and provide cables with good signal propagation, power delivery and breakdown voltage. As a result, the coaxial cables of the invention are useful in applications when one or more of these benefits are desired.

It is understood that upon reading the above description of the present invention, one skilled in the art could make changes and variations therefrom. These changes and variations are included in the spirit and scope of the following appended claims.

That which is claimed:

1. A method of making a coaxial cable comprising the steps of:

advancing along a predetermined path of travel a cable core comprising a conductor and an expanded foam dielectric surrounding the conductor;

directing an elongate strip of copper onto the advancing cable core and bending the copper strip into a generally cylindrical form so as to loosely encircle the core;

moving opposing longitudinal edges of the thus formed copper strip into abutting relation and forming a longitudinal weld joining the abutting edges to thereby form an electrically and mechanically continuous tubular copper sheath loosely surrounding the cable core;

simultaneously advancing the cable core and the surrounding sheath while deforming the tubular sheath into an oval configuration loosely surrounding the core, the oval configuration having a major axis generally aligned with the longitudinal weld of said sheath;

directing the longitudinal weld of the advancing sheath against a scarfing blade and scarfing weld flash from the sheath; and sinking the advancing copper sheath onto the advancing cable core.

2. The method according to claim 1 further comprising the step of advancing the thus formed coaxial cable through an extruder and extruding a polymer composition around the copper sheath to form a protective jacket surrounding the coaxial cable.

3. The method according to claim 2 wherein said step of extruding a polymer composition around the copper sheath comprises coextruding a molten adhesive composition into surrounding relation to the copper sheath and a molten thermoplastic polymer composition into surrounding relation to the adhesive composition to form a protective polymer jacket adhesively bonded to the sheath.

4. The method according to claim 2 wherein said step of extruding a polymer composition around the copper sheath comprises coextruding a longitudinal tracer stripe of a polymer composition contrasting in color to said protective polymer jacket.

5. The method according to claim 1 wherein said sinking step comprises simultaneously advancing the cable core and the surrounding sheath through at least one sinking die and sinking the copper sheath onto the cable core to cause compression of the foam dielectric of the core.

6. The method according to claim 1 comprising the additional step, performed prior to said sinking step, of reforming the tubular sheath from an oval configuration into a generally circular configuration loosely surrounding the core.

7. The method according to claim 1 comprising the additional steps, performed prior to said step of advancing the cable core, of:

advancing a conductor into and through an extruder and extruding thereon a foamable polymer composition; and causing the extruded polymer composition to foam and expand to form a cable core comprised of an expanded foam dielectric surrounding the advancing conductor.

8. The method according to claim 7 further comprising the step of applying an adhesive to the conductor before extruding the foamable polymer composition onto the conductor.

9. A method according to claim 1 wherein said step of directing an elongate strip of copper comprises directing a strip of copper having a thickness selected such that the thickness of said tubular copper sheath is no greater than about 1.6 percent of the diameter of said tubular copper sheath.

10. A method of making a coaxial cable comprising the steps of:

advancing a conductor into and through an extruder and extruding thereon a foamable polymer composition;

causing the extruded polymer composition to foam and expand to form a cable core comprised of an expanded foam dielectric surrounding the advancing conductor;

directing an elongate strip of copper onto the advancing cable core and bending the strip into a generally cylindrical form so as to loosely encircle the core;

moving opposing longitudinal edges of the thus formed copper strip into abutting relation and forming a longitudinal weld joining the abutting edges to thereby form an electrically and mechanically continuous tubular copper sheath loosely surrounding the cable core;

simultaneously advancing the cable core and the surrounding sheath while deforming the tubular sheath into an oval configuration loosely surrounding the core, the oval configuration having a major axis generally aligned with the longitudinal weld of said sheath;

directing the longitudinal weld of the advancing sheath against a scarfing blade and scarfing weld flash from the sheath;

simultaneously advancing the cable core and the surrounding sheath through at least one sinking die and sinking the copper sheath onto the cable core to cause compression of the foam dielectric of the core and to produce a coaxial cable;

advancing the thus formed coaxial cable through an extruder and extruding a polymer composition around the copper sheath to form a protective jacket surrounding the coaxial cable.

11. The method according to claim 10 wherein said step of extruding a polymer composition around the copper sheath comprises coextruding a molten adhesive composition into surrounding relation to the copper sheath and a molten thermoplastic polymer composition into surrounding relation to the adhesive composition to form a protective polymer jacket adhesively bonded to the sheath.

12. A method according to claim 10 wherein said step of directing an elongate strip of copper comprises directing an elongate strip of copper having a thickness selected such that the thickness of said tubular copper sheath is no greater than about 1.6 percent of the diameter of said tubular copper sheath.

13. The method according to claim 10 including the step of applying an adhesive layer to the outer surface of the conductor prior to the step of extruding the foamable polymer composition.

14. The method according to claim 10 wherein the step of advancing a conductor into and through an extruder and extruding a foamable polymer composition comprises coextruding a foamable polymer composition in surrounding relation to the conductor and an adhesive composition in surrounding relation to the foamable polymer composition.

* * * * *